US009062383B2

(12) United States Patent
Ottaviani et al.

(10) Patent No.: US 9,062,383 B2
(45) Date of Patent: Jun. 23, 2015

(54) ELEMENTARY CELL AND RELEVANT MODULAR ELECTROLYSER FOR ELECTROLYTIC PROCESSES

(75) Inventors: Angelo Ottaviani, Milan (IT); Fulvio Federico, Piacenza (IT); Antonio Pasquinucci, San Giuliano Milanese (IT); Dario Oldani, Milan (IT); Michele Perego, Milan (IT)

(73) Assignee: UHDENORA S.P.A., Milan (IT)

( * ) Notice: Subject to any disclaimer, the term of this patent is extended or adjusted under 35 U.S.C. 154(b) by 122 days.

(21) Appl. No.: 12/998,488

(22) PCT Filed: Nov. 16, 2009

(86) PCT No.: PCT/EP2009/065214

§ 371 (c)(1), (2), (4) Date: Apr. 22, 2011

(87) PCT Pub. No.: WO2010/055152

PCT Pub. Date: May 20, 2010

(65) Prior Publication Data

US 2011/0259735 A1 Oct. 27, 2011

(30) Foreign Application Priority Data

Nov. 17, 2008 (IT) ..... MI2008A2035

(51) Int. Cl.

| | |
|---|---|
| ***C25B 9/02*** | (2006.01) |
| ***C25B 9/04*** | (2006.01) |
| ***C25B 9/08*** | (2006.01) |
| ***C25B 9/18*** | (2006.01) |
| ***C25D 17/04*** | (2006.01) |
| ***C25D 17/06*** | (2006.01) |

(52) U.S. Cl.
CPC ... *C25B 9/04* (2013.01); *C25B 9/08* (2013.01); *C25B 9/18* (2013.01)

(58) Field of Classification Search
CPC ..... C25C 7/02; C25C 7/00; C25C 3/10; C25C 17/08; C25C 9/02; C25B 9/02; C25B 9/04; C25B 9/08; C25B 9/18; C25D 17/04; C25D 17/06; C25D 17/001
USPC ..... 204/242, 253, 285, 286.1, 297.01, 636, 204/638, 196.2, 196.3, 196.31, 196.33, 204/196.17; 205/620
See application file for complete search history.

(56) References Cited

U.S. PATENT DOCUMENTS

| | | | | |
|---|---|---|---|---|
| 4,161,438 | A * | 7/1979 | De Nora et al. | 204/266 |
| 6,984,296 | B1 * | 1/2006 | Gestermann | 204/252 |

FOREIGN PATENT DOCUMENTS

| | | |
|---|---|---|
| EP | 1 580 303 | 9/2005 |
| GB | 2 056 493 | 3/1981 |
| WO | WO 01/40549 | 6/2001 |

*Primary Examiner* — Zulmariam Mendez
(74) *Attorney, Agent, or Firm* — Lucas & Mercanti, LLP

(57) ABSTRACT

An electrolysis cell provided with a separator, suitable for chlor-alkali electrolysis, has a planar flexible cathode kept in contact with the separator by an elastic conductive element pressed by a current distributor and an anode consisting of a punched sheet or mesh supporting the separator suitable for being individually pre-assembled and used as elementary unit of a modular arrangement to form an electrolyzer whose terminal cells only are connected to the electric power supply; the electrical continuity between adjacent cells being assured by conductive contact strips secured to the external anodic walls of the shells delimiting each cell with the stiffness of the cathode current distributor and of the anodic structure and the elasticity of the conductive element cooperate in maintaining a uniform cathode to separator contact with a homogeneous pressure distribution meanwhile ensuring a suitable mechanical load on the contact strips.

6 Claims, 3 Drawing Sheets

ELEMENTARY CELL AND RELEVANT MODULAR ELECTROLYSER FOR ELECTROLYTIC PROCESSES

This application is a 371 of PCT application PCT/EP2009/065214 filed Nov. 16, 2009.

Figure 1:
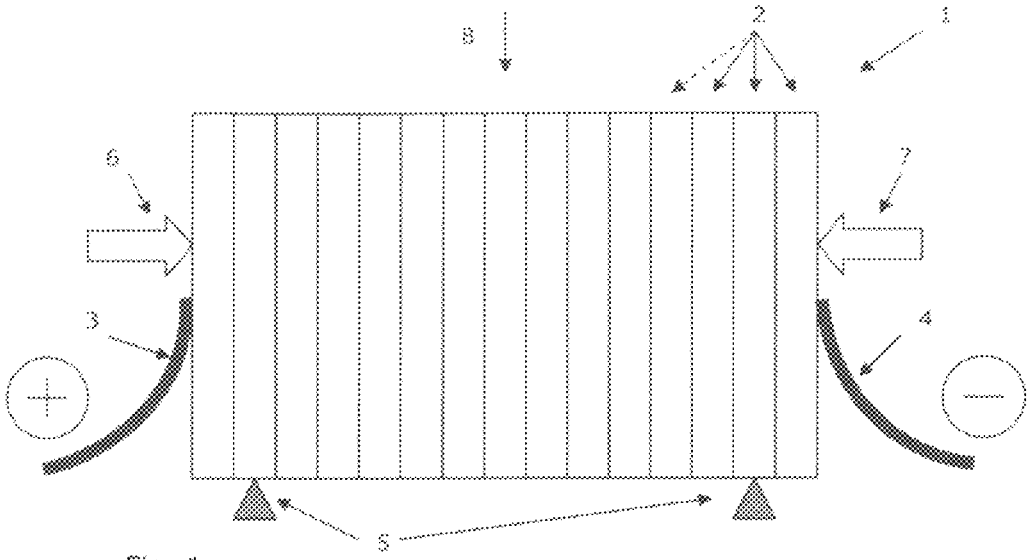

Industrial electrolysis processes, for instance water electrolysis for hydrogen and oxygen production and electrolysis of alkali brine, in particular of sodium chloride brine, directed to the production of chlorine, caustic soda and hydrogen, are commonly carried out in electrolysers of the type sketched in FIG. 1 wherein reference numerals indicate: 1 the electrolyser, 2 the elementary cells whose modular arrangement makes up the electrolyser, 3 and 4 respectively the connection to the positive and negative pole of an external rectifier, 5 the supports of the multiplicity of elementary cells which may be located below the electrolyser or alternatively may be shaped as cantilevers positioned in pairs along the sides of the electrolyser, 6 and 7 the pressure exerted by tie-rods or hydraulic jacks (not shown in the drawing) ensuring the tightness seal of process fluids to the environment jointly with peripheral gaskets (not shown in the drawing) and in some types of electrolysers also aimed at improving the electrical continuity between the various cells. The electrolyser is also equipped with suitable nozzles and hydraulic connections allowing to supply the solutions to be electrolysed and to withdraw the products and the residual exhausted solutions (also omitted in the drawing for the sake of a better readability).

Figure 2:
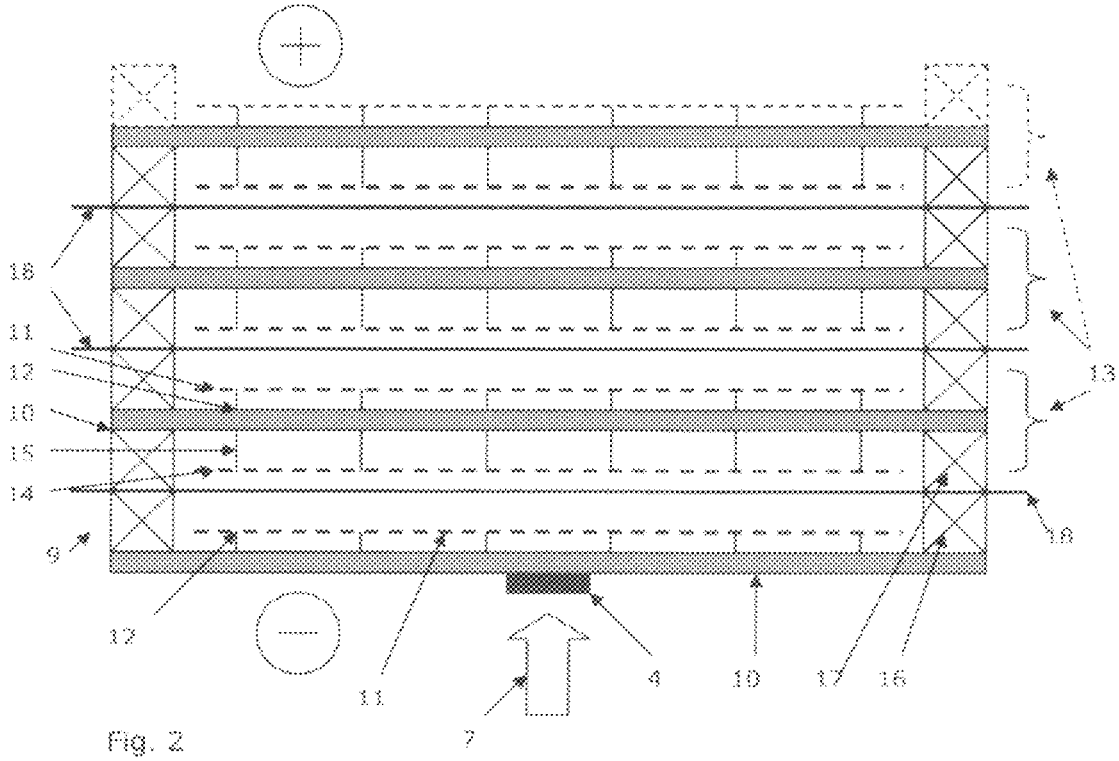

FIG. 2 represents a cross-section, along the direction indicated by arrow 8, of the terminal part of the electrolyser connected to the negative pole, showing a terminal element and a multiplicity of individual bipolar elements according to a common design in the industrial practice. Reference numerals indicate:

9 the terminal cathodic element comprising a wall 10 and cathode 11 consisting of a punched sheet or mesh supported by cathodic vertical strips 12;

13 the individual bipolar elements comprising wall 10, cathode 11 and anode 14 consisting of punched sheets or meshes and respectively supported by cathodic and anodic vertical strips 12 and 15;

16 and 17 the peripheral gaskets fastening separator 18 (for instance a porous diaphragm or ion-exchange membrane) under the compression generated by external tie-rods or jacks, ensuring the tightness seal of electrolytes and electrolysis products contained in the cathode and anode compartments to the environment.

In the sketch of FIG. 2, the various internal components are shown as separate for a better understanding: in the practice, separators 18 are in contact with anodes 14 supporting the same while cathodes 11 are spaced apart, for instance by a 1-2 mm gap. In view of the size of bipolar elements 13 which can have a height of 1-1.5 meters and a length of 2-3 meters, it is apparent how obtaining the required planarity and parallelism of cathodes and anodes entails a remarkable difficulty of construction. Furthermore, the assembly of electrolyser 1 requires a particular care by operative staff that must carry out a sequence of operations comprising the periodic repetition of the vertical positioning on the relevant supports of a bipolar element provided on the two faces with the required peripheral gaskets fixed with an adhesive, with the anodic surface facing the operators, followed by the application of the separator onto the anode surface and the gaskets: among the difficulties of such an assembly sequence are to be noted the tendency of the separator to slide downwards, complicating the precise positioning thereof, and the necessity of keeping the mutual alignment of the distinct bipolar elements. The multiplicity of bipolar elements positioned on the supports is finally compressed by external tie-rods or hydraulic jacks in order to ensure the required tightness seal to the external environment: in this phase, any slight misalignment of the various bipolar elements or an even minimal sliding of the separators can lead to damaging the latter, thwarting their regular functioning. Even when this doesn't occur, the possible deviations from tolerances as regards cathode to anode parallelism and the relevant gap give rise to an inhomogeneity of electric current distribution negatively affecting the quality of electrolysis and the lifetime of separators, particularly if the latter consist of ion-exchange membranes. Moreover, in case of malfunctioning of a bipolar element and/or of a separator, the replacement intervention entails the release of the compression applied by the external tie-rods or hydraulic jacks with the consequent possibility of a reciprocal sliding of bipolar elements with respect to separators: this situation may lead to additional damaging in the course of the subsequent retightening of tie-rods or hydraulic jacks.

Figure 3:
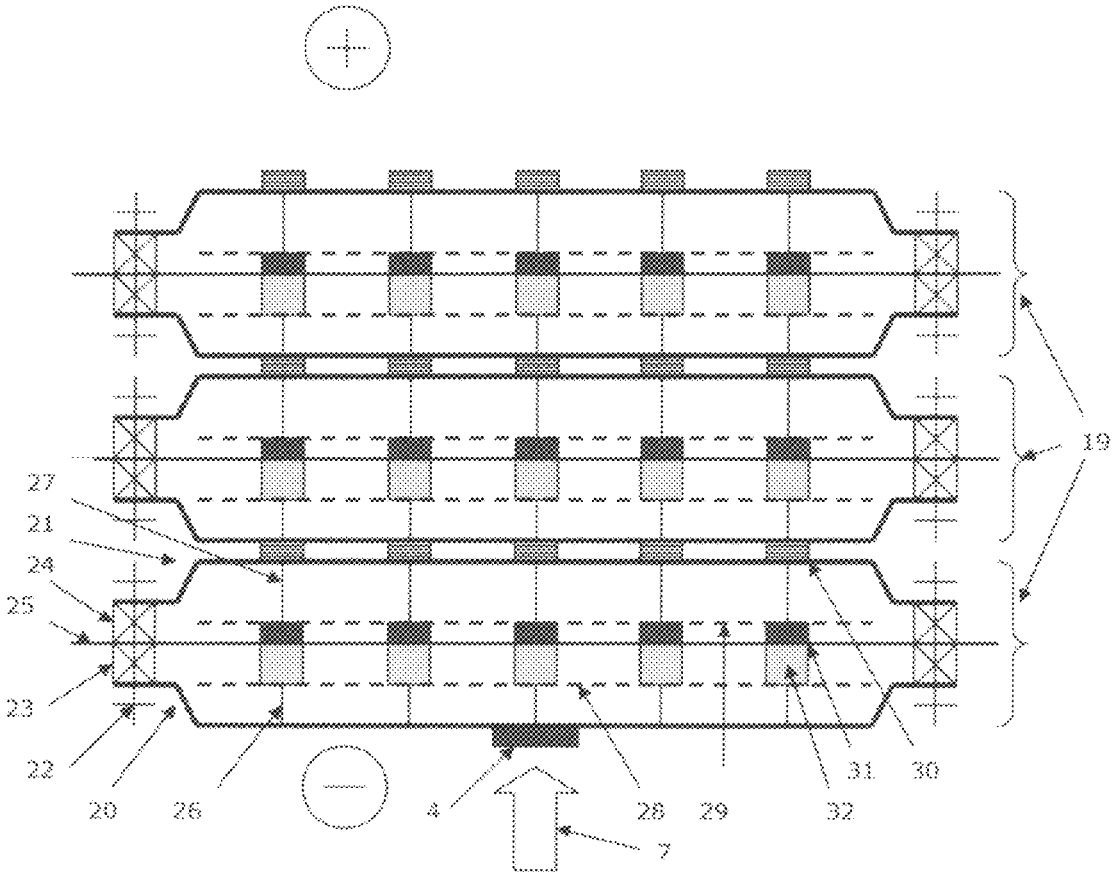

The sketch of FIG. 3 represents a cross-section, along the direction indicated by arrow 8, of the negative terminal portion of a different type of electrolyser: in this case the electrolyser is formed by a multiplicity of individual cells 19 according to a single-cell type design. Each individual cell 19 comprises two shells, a cathodic 20 and an anodic one 21, mutually tightened by means of a series of bolts 22 positioned along the external perimeter: under the compression generated by the bolts, the cathodic gasket 23 and the anodic gasket 24 fasten separator 25 therebetween ensuring the tightness seal to the external environment. The two shells 20 and 21 are provided with cathodic and anodic vertical internal strips, respectively indicated as 26 and 27, whereto are respectively fixed the cathodic 28 and anodic 29 punched sheets or meshes, and finally vertical contact strips 30 positioned on the external surface of anode shells 21 in correspondence of the cathodic and anodic internal strips, directed to ensure the electrical continuity between the various individual cells of the electrolyser. As in the case of FIG. 2, also for FIG. 3 cathodes, anodes and separators are represented as separate elements for a better understanding of the cell internal structure: in the practice, the separators are in contact with the supporting anodes, while the cathodes are at a predefined finite gap. Each individual cell of the single-cell type further comprises a series of spacers 31 and 32 aligned with contact strips 30 and made of an electrical insulating material, preferably PTFE due to its chemical inertia. The function of spacers 31 and 32 is of utmost importance and specifically characterises the single-cell design: under the effect of the external tie-rod or hydraulic jack compression, the spacers, whose thickness is carefully calibrated (the thickness being for instance set at 1-2 mm with a mechanical tolerance below 0.1 mm), fasten the separators each other without damaging them, allow adjusting the peripheral gasket compression and cause an albeit marginal deflection of the structure so as to ensure an excellent parallelism at a practically constant and predefined gap also in case of consistent deviations from constructive tolerances. Furthermore, spacers allow concentrating the mechanical load of the external tie-rods or hydraulic jacks onto the external contact strips generating a pressure sufficient for guaranteeing a minimised electrical resistance. The anode surface portions whereon the spacer pressure is exerted are of course suitably flattened to avoid damaging the separators.

The advantage of the above illustrated design is essentially given by the possibility of individually assembling each single-cell in the horizontal position, in the assembling section of the plant: the horizontal position greatly facilitates the reciprocal positioning of shells, gaskets, spacers and especially separators. Once the assembly operations are concluded with the closure of the peripheral bolting, the single-cell is placed on the supports and, once positioned the whole multiplicity of individual cells, the assembly is fastened under the action of external tie-rods or hydraulic jacks accomplishing the electrical continuity between the various cells and the parallelism at a predefined gap between cathodes and anodes. Finally, the single-cell design allows preventing any damaging to the separators and achieving, by virtue of the predefined gap parallelism of cathodes and anodes, a homogeneous distribution of electrical current ensuring a better quality of the electrolytic process and a longer separator lifetime. Moreover, in case of malfunctioning of a single-cell, the maintenance procedure also in this case requires the release of the pressure exerted by the external tie-rods or hydraulic jacks, without requiring however the opening of individual cells, so that the internal asset of the various internal component is untouched: hence, the possible interventions for replacing malfunctioning single-cells do not imply any damaging in the subsequent fastening stage of tie-rods or hydraulic jacks. The above illustrated technologies, providing cathode-anode gaps around 1-2 mm, are characterised in the industrial practice by a specific electrical energy consumption per unit product that have been considered so far satisfactory: nevertheless, the constant increase in the price of electrical energy is pushing towards novel designs capable of granting sensible energy savings.

Figure 4:
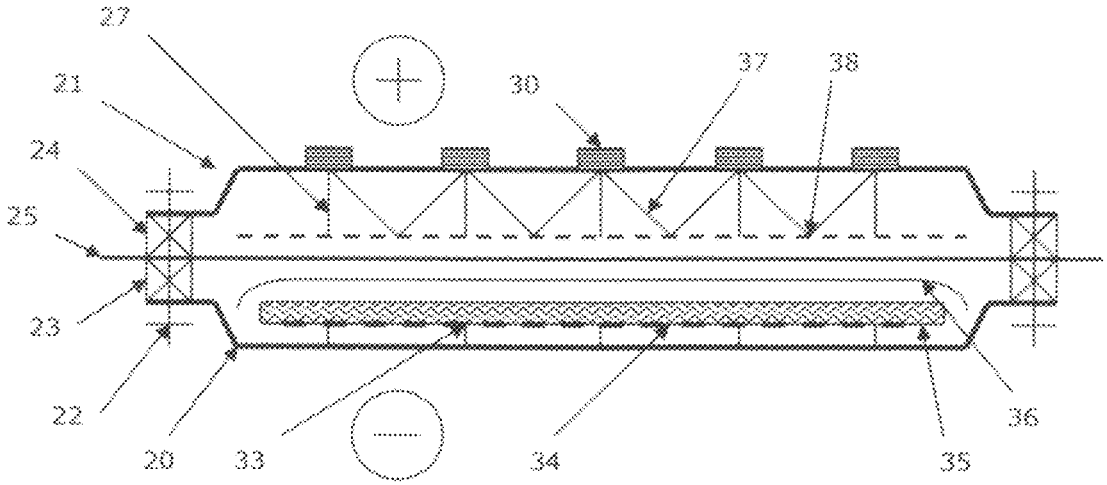

The novel single-cell design illustrated hereafter achieves this objective by eliminating the cathode to anode gap as schematized in FIG. 4, representing the top-view of an individual cell. The elements in common with the drawing of FIG. 3 (shells, peripheral gaskets, separator, anodic vertical strips, anodes and contact strips) are indicated with the same reference numerals: the differentiating elements consist of lowered cathodic strips 33, having a punched sheet or mesh 34 fixed thereto, an elastic element 35, for instance consisting of the juxtaposition of two or more corrugated conductive metal cloths or of a mat formed by interpenetrated coils obtained from one or more metal wires, and a thin punched sheet or flexible planar mesh 36 acting as the cathode. The lowering of the cathodic vertical strips 33 allows to create the necessary room for introducing elastic element 35. When the preassembled cell is installed on the supports and is subjected to the pressure exerted by tie-rods or hydraulic jacks, sheet or mesh 34 compresses elastic element 35, in its turn compressing cathode 36 against separator 25 supported by anode 29. The elasticity of element 35 makes sure that cathode 36 is kept in continuous and uniform contact with the separator, independently from the unavoidable small deviation from the ideal planarity and parallelism of anode 29 and sheet or mesh 34, which practically acts as a current distributing element to the elastic element and across the latter to the flexible cathode. In this way it is guaranteed that during operation the electrical current is distributed in a uniform fashion and consequently that individual cell voltages, whereon energy consumption depends, are minimised. As it can be noticed in the sketch of FIG. 4, the use of elastic element 35 entails the elimination of spacers 31 and 32 with the apparent risk that, in correspondence of deviations from parallelism of sheet or mesh 34 and anode 29, an excessive compression of separator 25 against the anode could be produced, with consequent damaging of the membrane. This risk can be reduced if sheets or meshes 34 and anode 29 are reinforced increasing the stiffness thereof and/or if the distance between adjacent cathodic 33 and anodic strips 27 is decreased: such two measures imply however additional costs for the increased usage of materials and the consequent need of increasing also the number of contact strips 30. One alternative embodiment provides increasing the thickness of sheet or mesh 34 only, ensuring the required anode stiffness by introducing V-shaped vertical elements 37 between each pair of anodic strips 27: vertical elements 37 may be manufactured out of plastic material, in this case being forcibly inserted, or out of metal, in this case being optionally fixed by weld spots. Apexes 38 of elements 37 act as a linear abutment surface for the sheet or mesh of anode 29 whose deflection is thereby greatly reduced without having to increase the thickness thereof or the number of anodic strips and consequently of contact strips. Elements 37, if suitably dimensioned, may also advantageously act as internal recirculation promoters. Finally, edges of elements 37 contribute to partially discharge pressure exerted by elastic element 35 to the foot of anodic strips 27 and thus of contact strips 30, effectively contributing to keep a low contact resistivity between each pair of adjacent cells.

The application of this cathode to anode zero-gap design making use of a cathode in form of flexible planar sheet or mesh coupled to an elastic element is particularly suited to the single-cell type technology wherein, as discussed, cell preassembly can be carried out before proceeding with the positioning on the electrolyser supports. Pre-assembly in particular, carried out in the relevant assembly plant section, is effected with the cell in the horizontal position: positioning of the cathode and the relevant elastic pressure element, besides the one of the separator, is therefore greatly facilitated. Conversely, the application to the electrolyser type of FIG. 2 consisting of a multiplicity of bipolar elements turns out to be very problematic because, besides the already mentioned risks of separator sliding and bipolar element misalignment, the inconveniences of cathode sliding and of elastic element downward deflection and sliding may occur: for this reason, upon fastening the multiplicity of bipolar elements with the relevant gaskets, separators, cathodes and elastic elements, pressure distribution anomalies may take place, with negative consequences on the regularity of the subsequent functioning.

The efficacy of the cathode to anode zero-gap design making use of a cathode coupled to an elastic pressure element was verified on a pilot electrolyser for membrane chlor-alkali electrolysis. The electrolyser was equipped with eight single-cells preassembled in the horizontal position and subsequently installed on their supports. The cells were of standard industrial size (1.2 meters height and 2.7 meters length), each comprising a cathode shell made of nickel just as the relevant internal components (cathodic strips, rigid mesh acting as current distributor, elastic element consisting of two mats of 0.6 m height and 2.7 m length formed by interpenetrated double-wire coils having a diameter of about 0.2 mm, flexible planar cathode provided with a catalytic coating for hydrogen evolution), an anode shell made of titanium just as the relevant internal components (anodic strips, V-shaped support elements, anode provided with a catalytic coating for chlorine evolution, external contact strips made of titanium coated with a nickel film to minimise the contact electrical resistance), gaskets of chemically resistant rubber and a N2030 type cation-exchange membrane manufactured by DuPont/USA. The electrolyser was operated with 32% by weight caustic soda, sodium chloride brine at an outlet concentration of 210 g/l, at 90° C. and at a current density of 5 kA/m$^2$. After a period of stabilisation of about 1 week, the cells were characterised by an average voltage of 2.90 V, which was substantially unchanged after 6 months of operation, when the electrolysis was discontinued and two single-cells were displaced from their supports, opened and subjected to a visual inspection of their components. The inspection did not evidence any notable alteration, in particular the two membranes presented a surface practically free of creases or other traces generated by an anomalous compression of the cathode. The two cells were reassembled and installed again on the supports of the electrolyser, which was then started up: the voltages of the single-cells, including the two cells that were inspected, were back to the value prior to the shut-down. As a comparison, in the case of an electrolyser equipped with cells having the same structure but without a pressure mat and characterised by a cathode to anode gap of 1.5 mm, according to the structure of FIG. 3, the average cell voltage with the same membrane and operating conditions is around 3.15 V, corresponding to a sensible increase in the energy consumption of about 170 kWh per tonne of product caustic soda.

The invention claimed is:

1. Elementary electrolysis cell comprising a cathode shell and an anode shell reciprocally fastened by means of a peripheral bolting with interposition of a peripheral cathode gasket, a peripheral anode gasket and a separator, said cathode shell containing an electrical current distributor in form of punched sheet or mesh fixed on vertical internal cathodic strips, a flexible cathode in form of punched sheet or mesh in electrical contact with said current distributor and in uniform contact with said separator, a conductive elastic element positioned between said current distributor and said flexible cathode, said anode shell containing an anode in form of punched sheet or mesh in uniform contact with said separator fixed on vertical internal anodic strips and conductive anodic contact strips externally positioned in direct correspondence with the internal anodic strips, wherein a plurality of V-shaped elements are introduced between each pair of said internal anodic strips, each V-shaped element having two legs of equal length meeting at an apex, the apexes of the plurality of V-shaped elements being in direct contact with and further supporting the anode.

2. The cell of claim 1 wherein said elastic element consists of at least two juxtaposed and corrugated cloths.

3. The cell of claim 1 wherein said elastic element consists of a mat of interpenetrated coils.

4. The cell of claim 2 wherein said interpenetrated coils are formed by at least two metal wires.

5. The cell of claim 1 wherein said separator is an ion-exchange membrane and said cathode shell, said rigid electrical current distributor, said cathodic strips, said cathode and said elastic element are made of nickel and said anode shell, said internal anodic strips and said anode are made of titanium and the said external anodic contact strips are made of titanium coated with a nickel layer.

6. An electrolyser consisting of a modular arrangement of a multiplicity of individually preassembled elementary cells of claim 1.

* * * * *